US007565888B2

(12) United States Patent
Sawdon et al.

(10) Patent No.: US 7,565,888 B2
(45) Date of Patent: Jul. 28, 2009

(54) SYSTEM TO RELEASE A STUCK LOCK-PIN IN A CAM PHASER

(75) Inventors: Craig Michael Sawdon, Williamston, MI (US); Jerry William Kortge, Clarkston, MI (US); John E. Doane, Goodrich, MI (US); Gregory J. York, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 718 days.

(21) Appl. No.: 11/112,753

(22) Filed: Apr. 22, 2005

(65) Prior Publication Data

US 2006/0236964 A1 Oct. 26, 2006

(51) Int. Cl.
*F01L 1/34* (2006.01)

(52) U.S. Cl. ..... 123/90.17; 123/90.15; 123/90.31

(58) Field of Classification Search ..... 12/90.17, 12/90.15, 90.31
See application file for complete search history.

(56) References Cited

U.S. PATENT DOCUMENTS 6,330,870 B1 * 12/2001 Inoue et al. ..... 123/90.17

* cited by examiner

*Primary Examiner*—Zelalem Eshete

(57) ABSTRACT

A stuck lock-pin release system for a lock-pin in a cam phaser includes a stuck lock-pin detection module and a stuck lock-pin module that communicates with the stuck lock-pin detection module. The stuck-lock pin detection module periodically determines whether a lock-pin in a cam phaser is in a stuck park condition. When the lock-pin is in the stuck park condition, the stuck lock-pin module alternately biases the cam phaser in a first and second direction until the lock-pin is no longer in the stuck park condition.

12 Claims, 3 Drawing Sheets

SYSTEM TO RELEASE A STUCK LOCK-PIN IN A CAM PHASER

FIELD OF THE INVENTION

The present invention relates to cam phasers of internal combustion engines, and more specifically to methods and apparatus for detecting and correcting a stuck lock-pin in a cam phaser.

BACKGROUND OF THE INVENTION

Cam phasers create a variable rotational offset between an exhaust camshaft, an intake camshaft, and a crankshaft of an internal combustion engine (ICE). The degree of rotational offset generated by the cam phaser enables the ICE to be tuned for specific performance requirements by varying valve overlap, i.e., overlap between the exhaust and intake valves of the ICE. In applications where idle quality is important, a relatively small degree of valve overlap may be desired. In applications where nitrogen oxides (NOx) must be reduced, a relatively large amount of overlap may be desired. The cam phaser may provide charge dilution in the form of recirculated exhaust gases. Charge dilution is a method of adding a non-reacting substance to the air/fuel mixture in a cylinder of an ICE to decrease the heat capacity of the air/fuel mixture and thus reduce the amount of NOx components.

A cam phaser typically includes a cylindrical stator and a vaned rotor. The stator is mounted onto a crankshaft driven gear or pulley and typically has a plurality of radically-disposed inward-extending spaced-apart lobes and an axial bore. The rotor is mounted to the end of the camshaft through the stator axial bore and has vanes disposed between the stator lobes to form actuation chambers such that limited relative motion is possible between the stator and the rotor.

The cam phaser is provided with suitable porting so that hydraulic fluid, for example, engine oil under engine oil pump pressure, can be brought to bear controllably on opposites sides of the vanes in advancing and retarding chambers. Control circuitry and valving permit the addition and subtraction of oil to the advance and retard chambers. Changes in rotational phase between the stator and rotor cause changes in timing between the pistons and the valves.

Under conditions of low engine oil pump pressure, such as during startup, it is desirable to mechanically lock the rotor and stator together in a default mode to prevent unwanted angular movement of the rotor relative to the stator. This is typically accomplished by a hydraulically activated lock-pin disposed in the rotor and positioned parallel to the rotational axis of the stator. When the oil pump pressure reaches a predetermined level, the hydraulic force of the oil causes the locking pin to retract from the pin bore and into the rotor. As a result, the rotor is decoupled from the stator and cam shaft phasing can occur.

In an effort to reduce rattling noise during startup, clearance between the lock-pin and pin bore is very tight. This tight clearance increases the potential for the cam phaser to move before the lock-pin is fully retracted. The result is a side load on the lock-pin that is sufficient to prevent it from further retracting and thus the cam phaser remains stuck until the side load on the lock-pin is removed.

In one method, a control module cycles the cam phaser solenoid for a fixed number of cycles to remove debris from the valve when a performance diagnostic determines that the solenoid valve is stuck. This solution is acceptable for removing debris, but it is not well suited to address the condition of a stuck lock-pin.

SUMMARY OF THE INVENTION

A stuck lock-pin release system according to the present invention includes a stuck lock-pin detection module and a stuck lock-pin module that communicates with the stuck lock-pin detection module. The stuck-lock pin detection module periodically determines whether a lock-pin in a cam phaser is stuck in a park condition. When the lock-pin is stuck in the park condition, the stuck lock-pin module alternately biases the cam phaser in first and second directions until the lock-pin is no longer stuck in the park condition.

In other features, the stuck lock-pin module biases the cam phaser in the first direction until the lock-pin is no longer stuck in the park condition or a first period has expired. When the first period has expired, the stuck lock-pin module biases the cam phaser in the second direction until the lock-pin is no longer stuck in the park condition or a second period has expired.

In still other features, the lock-pin is stuck in the park condition when the desired cam position is greater than a first predetermined threshold and the measured cam position is less than a second predetermined threshold. When the lock-pin is stuck in the park condition, a stuck lock-pin flag is set until the lock-pin is no longer stuck in the park condition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
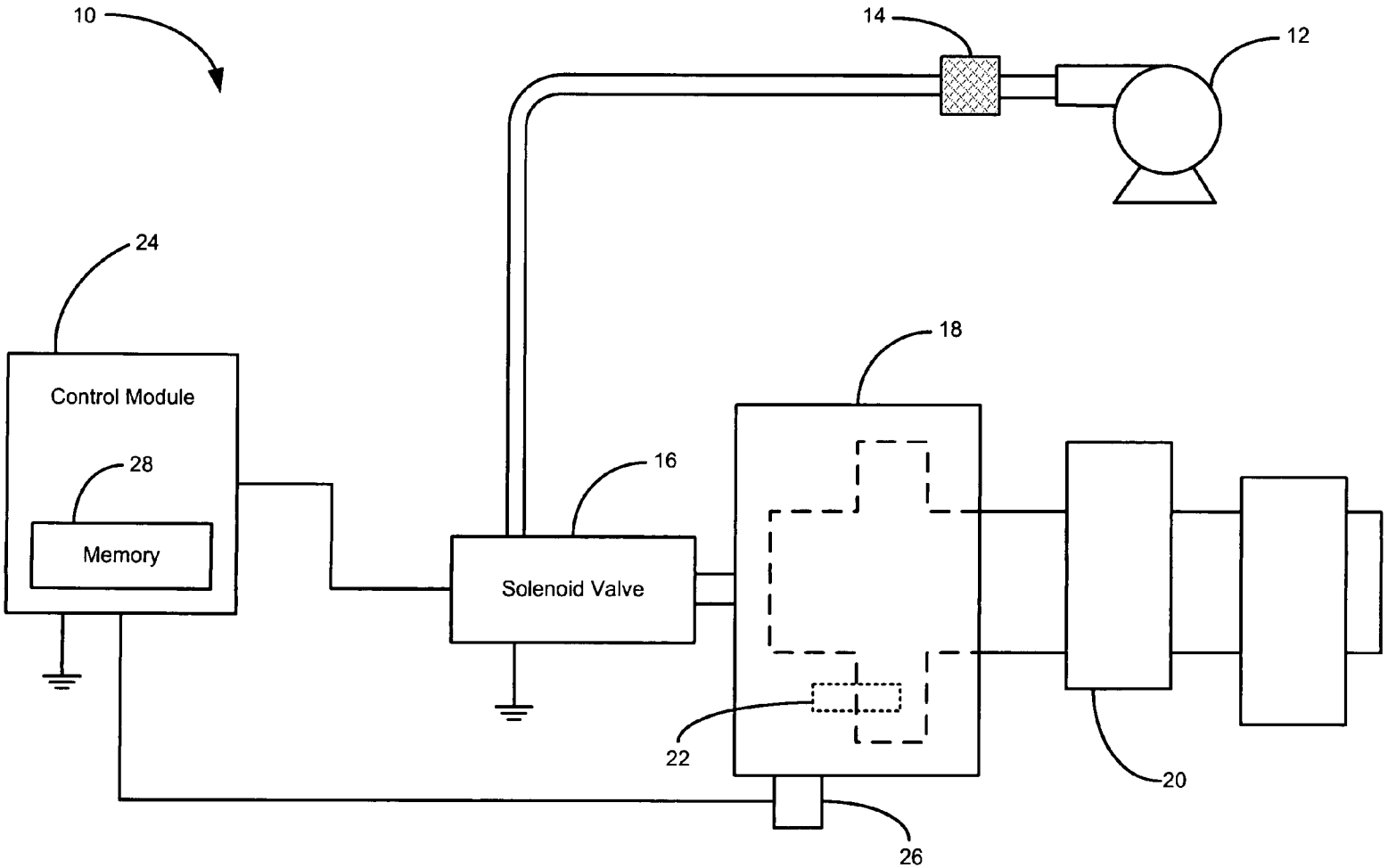
FIG. 1 illustrates a cam phaser control system including a control module that communicates with a solenoid valve which controls the phase of a cam phaser.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring to FIG. 1, a cam phaser control system 10 is provided with pressurized hydraulic fluid such as oil provided under pressure by an oil pump 12 through and an oil filter 14. A solenoid valve 16 controls the oil flow to a cam phaser 18, which in turn rotates a rotor in the cam phaser 18 to vary the phase of a cam 20. The cam phaser 18 includes a lock-pin 22 that prevents the cam 20 from varying its phase while the cam phaser 18 is in a park or zero phase position. A control module 24 controls the flow of pressurized oil with a solenoid valve 16 to position the cam 20. A cam position sensor 26 measures the position of the cam 20 and stores the measured value in memory 28 of the control module 24.

Figure 2:
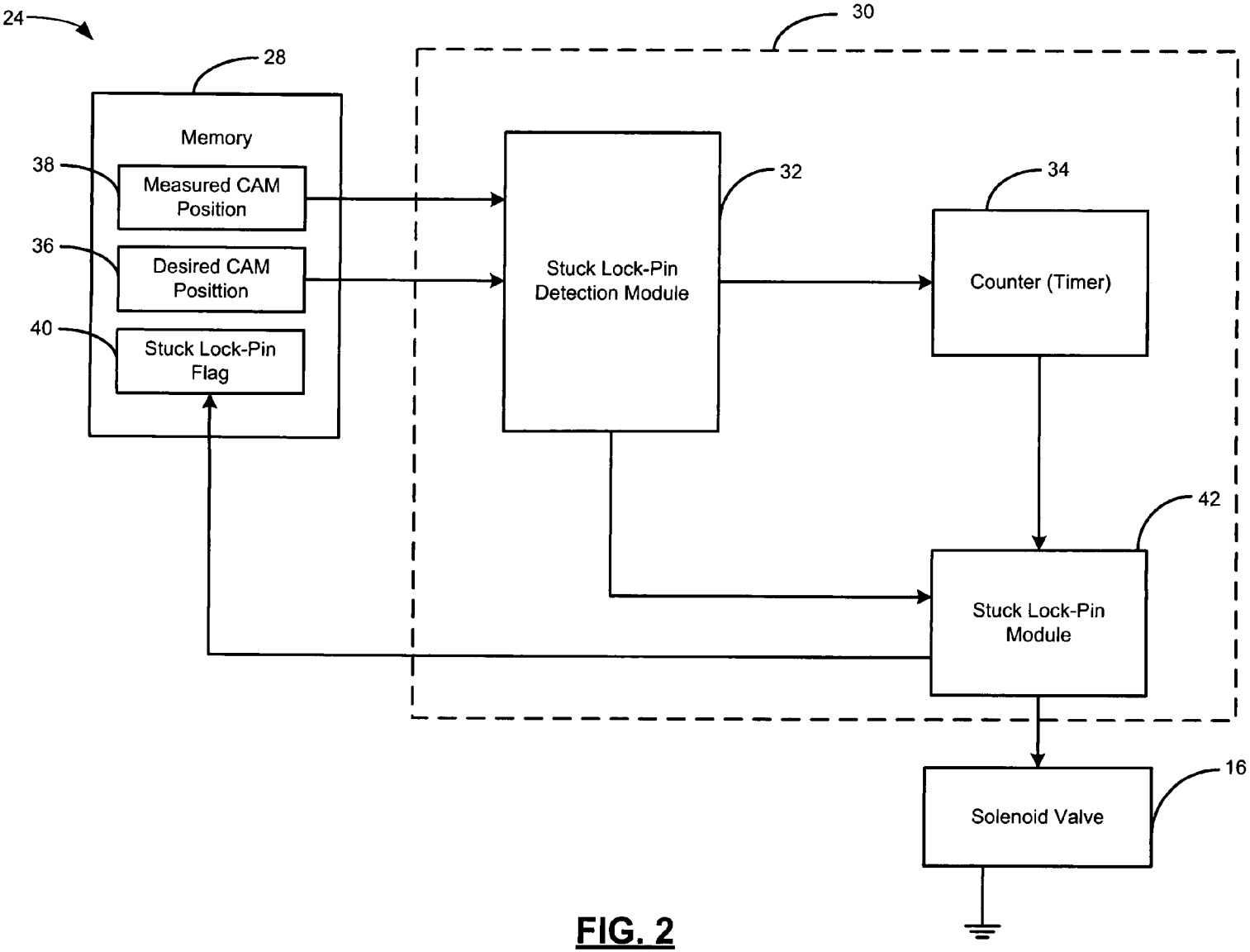
FIG. 2 is a functional block diagram of a stuck lock-pin release system according to the present invention.

Referring now to FIG. 2, a stuck lock-pin release system 30 includes a stuck lock-pin detection module 32 that determines whether the lock-pin 22 is stuck. In some implementations, the lock-pin 22 is essentially deemed stuck when desired cam position 36 is greater than the measured cam position 38. More specifically, the lock-pin 22 is deemed stuck when the desired cam position 36 is set above a first predetermined threshold and the measured cam position 38 is below a second predetermined threshold. When the stuck lock-pin detection module 32 determines that the lock-pin 22 is stuck, a counter 34 begins to increment. Once the counter increments to a predetermined value, a stuck lock-pin module 42 is enabled.

The stuck lock-pin module 42 sets a stuck-lock pin flag 40 to notify the control module 24 that the lock-pin 22 is stuck and that the stuck lock-pin release system 30 is currently running. The stuck lock-pin module 42 uses the counter 34 as a timing source to cycle the position of the solenoid valve 16. While the lock-pin 22 is stuck, the position of the solenoid valve 16 is moved into a desired position for a first predetermined period. If the stuck lock-pin detection module 32 determines that the lock-pin 22 is still stuck after the predetermined period, the stuck lock-pin module 42 moves the position of the solenoid valve 16 into a second desired position for a second predetermined period.

Moving the position of the solenoid valve 16 controls the flow of oil into the cam phaser 18 and thus controls the phase angle of the cam phaser 18. The stuck lock-pin detection module 32 periodically monitors the desired cam position 36 and the measured cam position 38. When the stuck lock-pin detection module 32 determines that the lock-pin 22 is no longer stuck, the stuck lock-pin module 42 is disabled, the stuck lock-pin flag 40 is cleared, and the counter 34 is reset.

Figure 3:
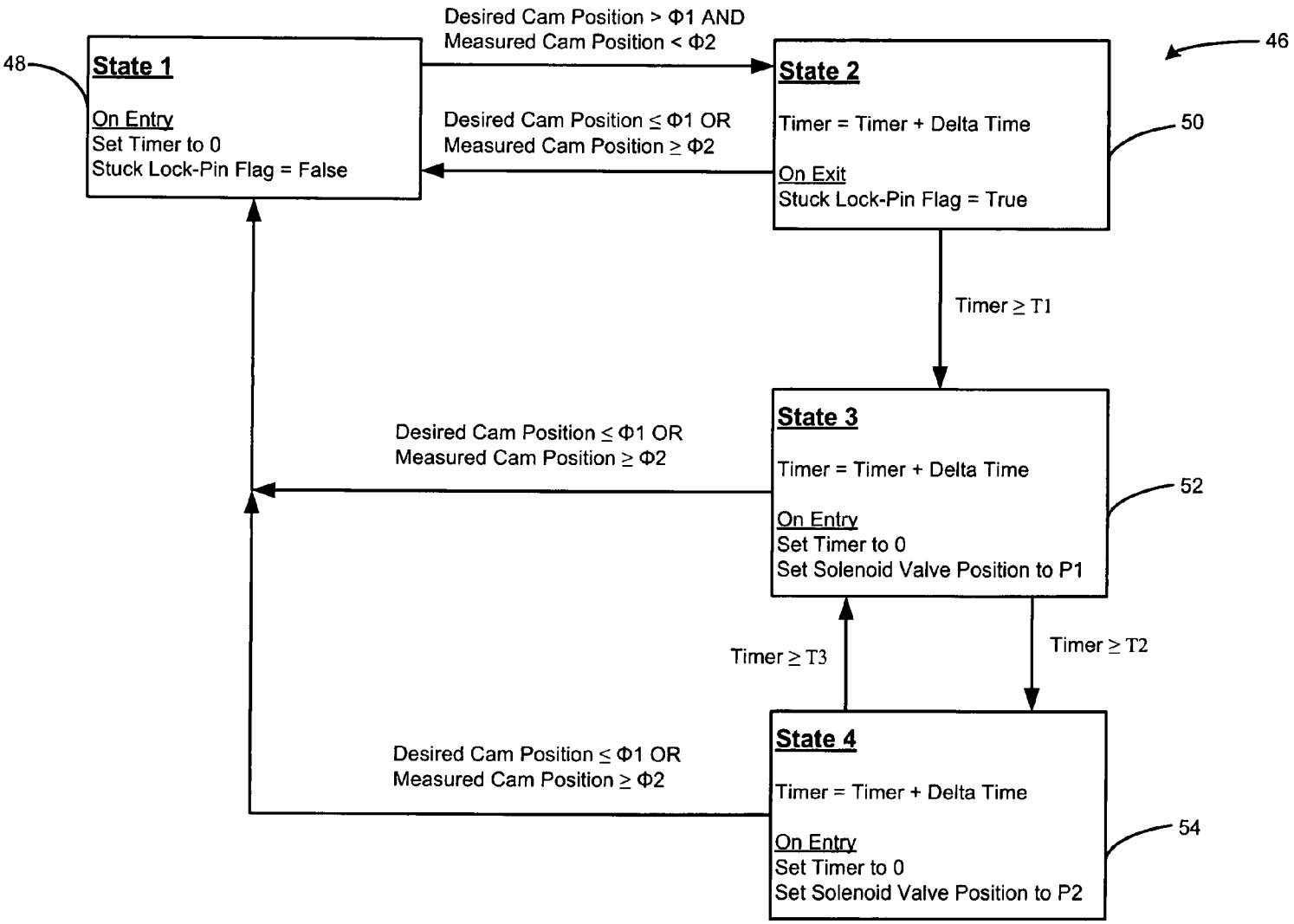
FIG. 3 is a state flow diagram of a stuck lock-pin release algorithm.

Referring now to FIG. 3, the stuck lock-pin release system 30 implements a state machine 46 to release a stuck lock-pin 22 in the cam phaser 18. When a vehicle is started, the stuck lock-pin release system 30 begins in state 48 where the counter 34 is set to an initial value and the stuck lock-pin flag 40 is cleared.

The stuck lock-pin release system 30 remains in state 48 until the desired cam position 36 is greater than a predetermined threshold $\phi 1$ and the measured cam position 38 is less than a predetermined threshold $\phi 2$. When this is true, the stuck lock-pin release system 30 enters state 50.

While in state 50, the counter 34 increments. The stuck lock-pin release system 30 remains in state 50 until the counter 34 is greater than or equal to a predetermined time T1 or the lock-pin 22 is no longer stuck. The stuck lock-pin detection module 32 determines that the lock-pin 22 is no longer stuck when the desired cam position 36 is less than or equal to $\phi 1$ or the measured cam position 38 is greater than or equal to $\phi 2$. If the counter 34 is greater than or equal to T1 the stuck lock-pin release system 30 exits state 50, sets the stuck lock-pin flag 40, and enters state 52. If the stuck lock-pin detection module 32 determines that the lock-pin 22 is no longer stuck, then the stuck lock-pin release system 30 returns to state 48.

When the stuck lock-pin release system 30 enters state 52, the counter 34 is reset and the solenoid valve 16 moves to a predetermined position P1. Moving the solenoid valve 16 into position P1 allows the flow of oil to attempt to change the phase angle of the cam phaser 18 to a value less than its current position. While in state 52 the counter increments. The stuck lock-pin release system 30 remains in state 52 until the counter is greater than or equal to a predetermined time T2 or the lock-pin 22 is no longer stuck. If the lock-pin 22 is no longer stuck then the stuck lock-pin release system 30 returns to state 48. If the counter is greater than or equal to T2 the stuck lock-pin release system 30 enters state 54.

When the stuck lock-pin release system 30 enters state 54 the counter 34 is reset and the solenoid valve 16 moves into a predetermined position P2. Moving the solenoid valve 16 into position P2 allows the flow of oil to attempt to change the phase angle of the cam phaser 18 to a value greater than its current position. While in state 54 the counter 34 increments. The stuck lock-pin release system 30 remains in state 54 until the counter 34 is greater than or equal to a predetermined time T3 or the lock-pin 22 is no longer stuck. If the lock-pin 22 is no longer stuck, the stuck lock-pin release system 30 returns to state 48. If the counter 34 is greater than or equal to T3 then the stuck lock-pin release system 30 returns to state 52.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A stuck lock-pin release system for a lock-pin of a cam phaser, comprising:

a stuck lock-pin detection module that periodically determines whether the lock-pin is stuck in a park condition; and a stuck lock-pin module that communicates with said stuck lock-pin detection module and that alternately biases the cam phaser in first and second directions when the lock-pin is stuck in said park condition.

2. The stuck lock-pin release system of claim 1 when the lock-pin is stuck in said park condition, said stuck lock-pin module biases the cam phaser in said first direction until a first period has expired and when the first period has expired biases the cam phaser in said second direction until the lock-pin is no longer stuck in said park condition or a second period has expired.

3. The stuck lock-pin release system of claim 1 wherein said lock-pin is stuck in said stuck park condition when the desired cam position is greater than a first predetermined threshold and the measured cam position is less than a second predetermined threshold.

4. The stuck lock-pin release system of claim 1 wherein a stuck lock-pin flag is set while the lock-pin is stuck in said park condition.

5. The stuck lock-pin release system of claim 4 wherein said stuck lock-pin flag is cleared when the lock-pin is no longer stuck in said park condition.

6. The stuck lock-pin release system of claim 1 wherein a counter is used as a timing source when the lock-pin is stuck in said park condition.

7. The stuck lock-pin release system of claim 6 wherein said counter is reset to an initial value when the lock-pin is no longer stuck in said park condition.

8. A method for releasing a lock-pin of a cam phaser that is stuck in a park condition, comprising:

periodically determining whether the lock-pin is stuck in a park condition; and alternately biasing the cam phaser in first and second directions when the lock-pin is stuck in said park condition.

9. The method of claim 8 further comprising:

when the lock-pin is stuck in said park condition, biasing the cam phaser in said first direction until a first period has expired; and when the first period has expired, biasing the cam phaser in said second direction until the lock-pin is no longer stuck in said park condition or a second period has expired.

10. The method of claim 8 wherein said lock-pin is stuck in said park condition when the desired cam position is greater than a first predetermined threshold and the measured cam position is less than a second predetermined threshold.

11. The method of claim 8 further comprising setting a stuck lock-pin flag while the lock-pin is stuck in said park condition.

12. The method of claim 11 further comprising clearing said stuck lock-pin flag when the lock-pin is no longer in said park condition.

* * * * *